US005100528A

United States Patent [19]

Claessens et al.

[11] Patent Number: 5,100,528

[45] Date of Patent: Mar. 31, 1992

[54] CONTINUOUS SILVER REFINING CELL

[75] Inventors: Pierre L. Claessens, St-Eustache; Bernard H. Morrison, Victoria; John L. Cromwell, Pincourt; Paul Spira, St-Laurent, all of Canada

[73] Assignee: Noranda, Inc., Toronto, Canada

[21] Appl. No.: 493,325

[22] Filed: Mar. 14, 1990

[30] Foreign Application Priority Data

Mar. 28, 1989 [CA] Canada ..... 594801

[51] Int. Cl.[5] ..... C25C 1/20; C25C 7/04; C25C 7/08

[52] U.S. Cl. ..... 204/212; 204/217; 204/252; 204/259; 204/262; 204/263; 204/264; 204/285; 204/290 F; 204/293

[58] Field of Search ..... 204/109, 212, 216-217, 204/263-266, 262, 285, 290 F, 293, 259, 252-258

[56] References Cited

U.S. PATENT DOCUMENTS 1,782,909 11/1930 Pike ..... 204/257 X 2,810,682 10/1957 Brown ..... 204/216 X 3,382,163 5/1968 Czaloun ..... 204/109 X

*Primary Examiner*—Donald R. Valentine

*Attorney, Agent, or Firm*—Fleit, Jacobson, Cohn, Price, Holman & Stern

[57] ABSTRACT

A continuous silver refining cell comprises a tank containing an electrolyte, at least one vertical cathode disk mounted on a rotating horizontal shaft placed above the tank so that slightly less than half of the disk is immersed in the electrolyte, at least one anode basket containing impure silver anodes immersed in the electrolyte adjacent the cathode disk, and a diaphragm separating the cathode disk from the anode basket to form cathode and anode compartments. A scraper is provided for continuously removing pure silver crystals from the cathode and directing it to the side of the cell. A chain tubular conveyor may be provided for continuously or semi-continuously withdrawing a mud containing gold and other precious metals from the bottom of the cell.

6 Claims, 4 Drawing Sheets

CONTINUOUS SILVER REFINING CELL

Figure 1:
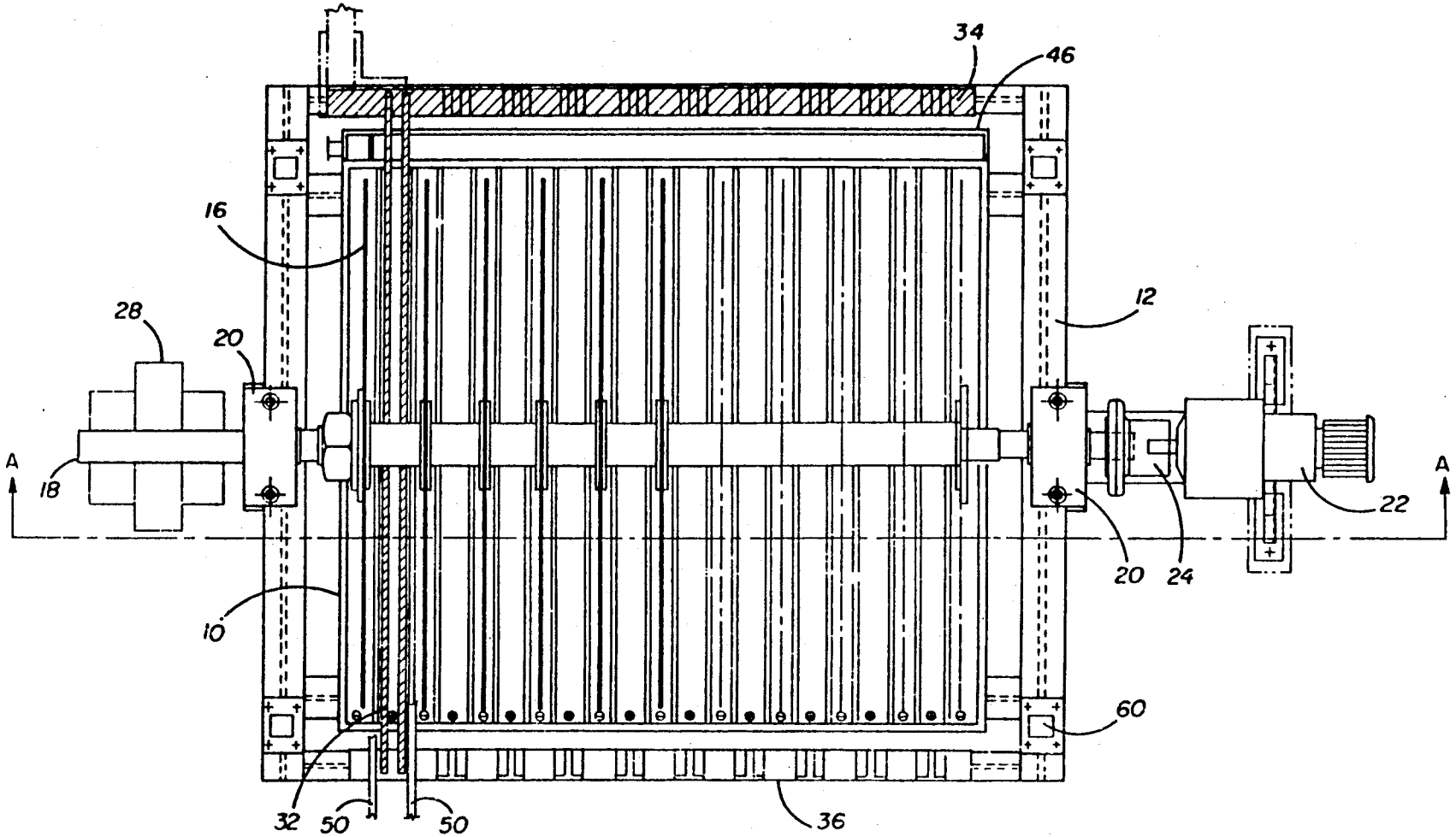

This invention relates to a continuous silver refining cell.

The impure silver anodes (often called Dore anodes) formed during treatment of electrolytic copper refinery slimes are normally electrolyzed using either the Moebius or the Balbach-Thum cells to recover silver. The conventional method of refining Dore anodes in Moebius or Balbach-Thum cells to produce refined silver and an anode mud containing gold and other precious metals is based on a batch operation which is labour intensive and also requires that substantial amounts of metals be tied-up in the process. In addition, the Moebius cell process generates considerable amounts of anode scrap (often exceeding 30%) that must be remelted and recirculated to the cells and the Balbach-Thum cells require a relatively larger floor area.

One continuous silver refining cell has been developed by Sumitomo Metal Mining Co. Ltd. and is disclosed by Hiraski Imazawa et al. in Metallurgical Review of MMIJ Vol 1, No. 1, March 1984. This cell consists of a vertical cylindrical cathode surrounded by anode baskets containing the Dore anodes. Silver is deposited on the exterior surface of the cylindrical cathode. This continuous cell reduces the amounts of precious metal tied-up in the process. However, this cell has a relatively small capacity and requires more floor space than the Moebius cells for an equivalent metal production because all the space inside the hollow cylindrical cathode is lost.

It is therefore the object of the present invention to provide a continuous silver refining cell which not only reduces the tie-up of precious metals in the cell, but also requires a minimum of floor space.

The continuous silver refining cell in accordance with the present invention comprises a tank containing an electrolyte, at least one vertical cathode disk mounted on a rotating horizontal shaft placed above the tank so that slightly less than half of the disk is immersed in the electrolyte, at least one anode basket containing impure silver anodes immersed in the electrolyte adjacent the cathode disk, a diaphragm separating the cathode disk from the anode basket to form cathode and anode compartments, means for continuously removing pure silver crystals from the rotating cathode disk and directing it to the side of the cell, and means for continuously or semi-continuously withdrawing a mud containing gold and other precious metals from the bottom of the tank. The anodes are completely dissolved and there is therefore no need to remelt anode scrap.

The cell tank is preferably divided into partitions to prevent silver crystals falling from the cathode disks into the electrolyte to mix with the mud containing gold and other precious metals. The diaphragm is placed in a window formed in the partitions and faces the cathode disks and the anode baskets.

The electrolyte is introduced into the cathode compartments and passes into the anode compartments through the diaphragms and is preferably recirculated through filtering equipment located outside the tank. The electrolyte temperature is also adjusted in the recirculation stream, for example by passage through an heat exchanger unit.

The means for continuously removing silver from the cathode disk is preferably a scraper assembly comprising a blade contacting the surface of the cathode disk and forming one wall of a trough which is supplied with water from a water source to direct silver to the side of the cell.

Figure 2:
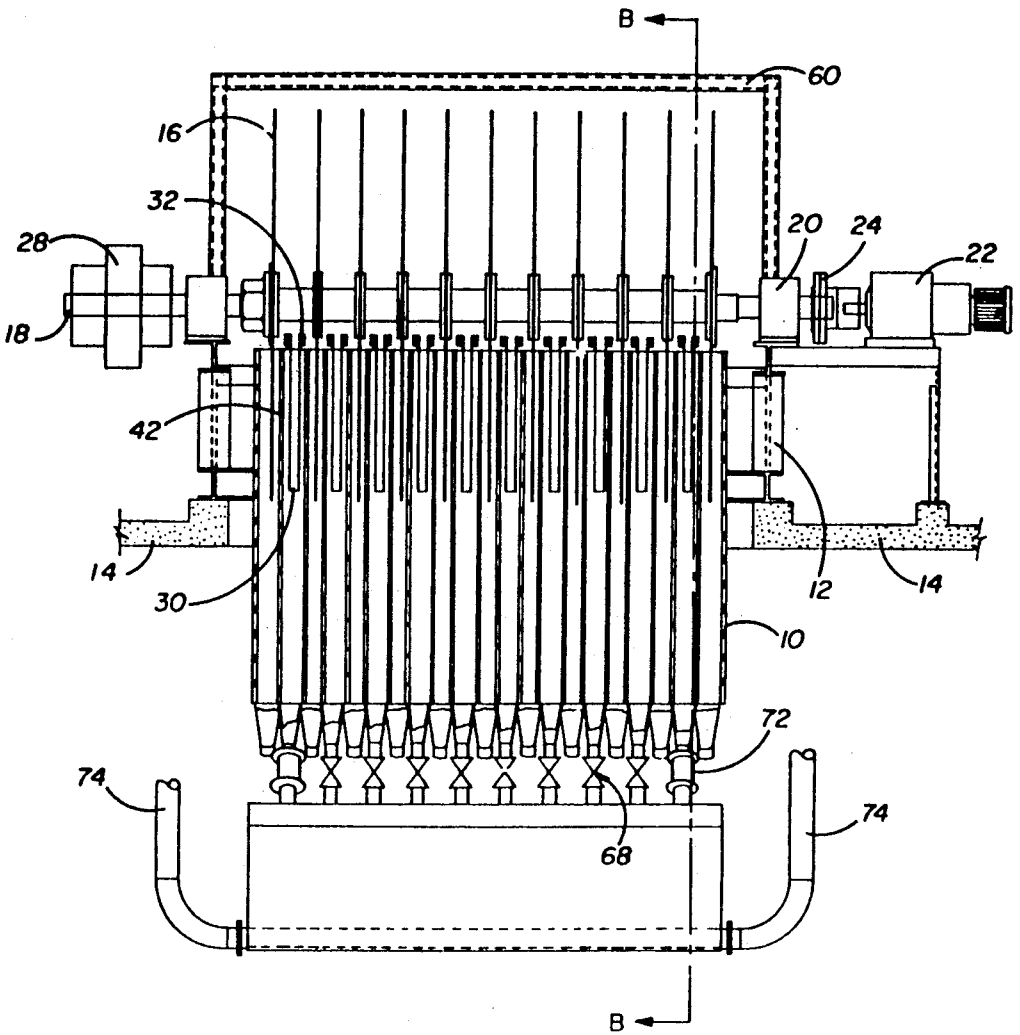
Figure 3:
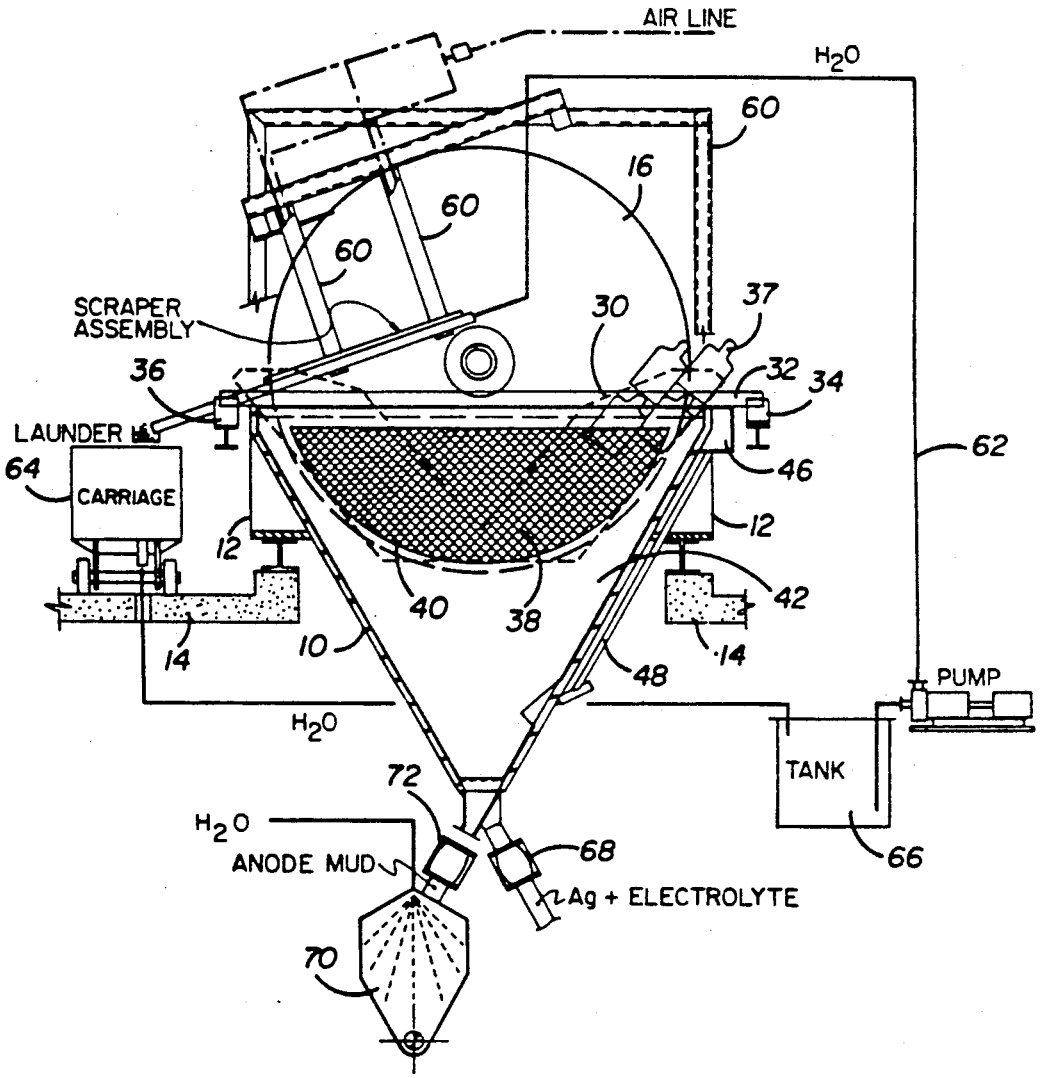
Figure 4:
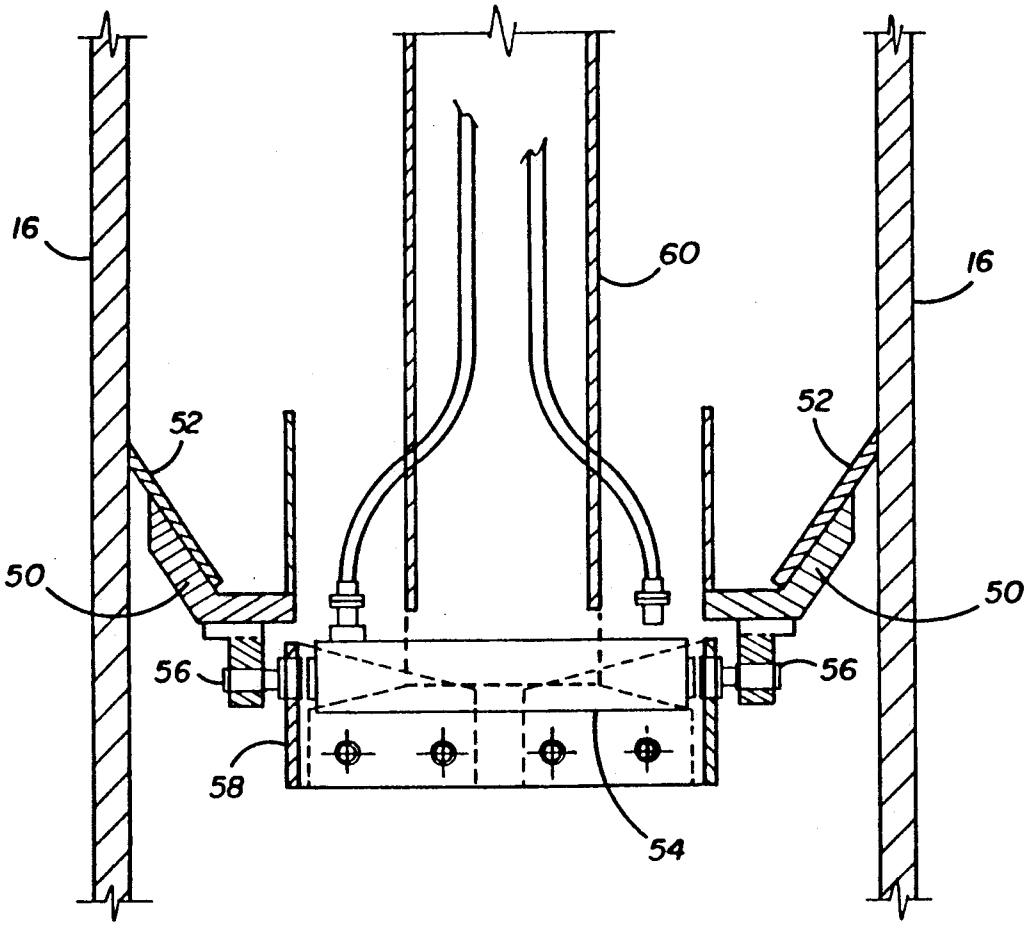

The invention will now be disclosed with reference to a preferred embodiment illustrated in the accompanying drawings in which:

FIG. 1 is a plan view of a continuous silver refining cell in accordance with the present invention, FIG. 2 is a section view along line A—A of FIG. 1, FIG. 3 is a section view along line B—B of FIG. 2, and FIG. 4 is a section view of the scraper assembly of the continuous silver refining cell.

Referring to FIGS. 1-3, there is shown a cell tank 10 constructed of polypropylene or other suitable material. The tank is supported on a suitable metal frame 12 resting on a cement base 14. A number of cathode disks 16 are fixed on a shaft 18 rotatably mounted on pillow blocks 20 which are secured to the frame. The shaft is driven by a variable speed gearmotor 22 through a flexible coupling 24. The shaft is normally made of current conducting material, such as copper, and also serves as the cathode bus bar. It is therefore insulated from the gearmotor, and the pillow blocks are also electrically insulated from the frame. Contact to the negative terminal of a suitable power supply is made through current distributor 28. The cathode disks are made of metals resistant to chemical attack by the electrolyte, such as titanium or stainless steel.

Anode baskets 30 made of metal mesh protected from dissolution by the formation of valve metal oxides, such as titanium, are located on either side of the cathode disks. The anode baskets are suspended in the tank from bus bars 32 which are electrically connected to the positive terminal of the power supply through a bus bar 34. Bus bars 32 are supported on the frame by insulating bus bar support 36 and current conducting bus bar 34 which is electrically insulated from the frame. Dore metal anodes are introduced in the baskets 30 in any conventional way.

The cathode disks are separated from the anode baskets by diaphragms 38 of any suitable material, such as woven cloth made of terrylene or other acid resistant materials, to form anode and cathode compartments. The diaphragms are mounted in windows 40 provided in partitions 42 located in the cell.

Electrolyte is recirculated between the cell and a reservoir (not shown) maintained at an appropriate temperature between 25° and 45° C. The electrolyte is preferably filtered and its temperature adjusted by passage through an heat-exchanger unit before being introduced in the cathode compartments through individual inlets (not shown), and exits the cell through a main overflow launder 46 connected to the anode compartments by means of pipes 48.

Silver crystals (hereinafter called silver sand) is produced at the cathode disks during operation of the cell. This silver sand is continuously removed using scraper assemblies mounted between adjacent disks. As shown in FIG. 4 of the drawings, each scraper assembly consists of a pair of plastic troughs 50 each holding a metal blade 52 held up against a disk by an air cylinder 54 having a double end piston rod 56. The cylinder 54 is secured to a support 58 which is fixed on a supporting structure 60 mounted on the main cell frame. The silver sand falling in the trough is washed away using a stream of recirculating water 62 which is directed into the troughs 50. The silver sand is collected in a carriage 64 and the water escaping from the bottom of the carriage is directed to a tank 66 located on the side of the cell. Any silver sand falling from the disks into the electrolyte can be collected through suitable pinch valves 68 installed at the bottom of the cell between alternate partitions 42.

The anode mud liberated during the course of the refining process and which falls to the bottom of the cell can be collected in a bin 70 through suitable pinch valves 72 installed at the bottom of the cell between alternate partitions 42. This anode mud may be removed from the bin by means of a chain tubular conveyor 74. The anode mud may be removed by other means. For example, the pinch valves could be opened, either manually or automatically, at regular time intervals and for a short time and the mud with a small amount of electrolyte dumped into buggies provided with a pre-filtration system to separate the solids from the major part of the electrolyte. It is seen that partitions 42 permit to separate any silver sand falling from the disk from the anode mud. The partitions would not be necessary if only an insignificant amount of non-adherent silver sand was falling to the bottom of the cell.

The above cell can be operated under similar conditions of current density, electrolyte composition and temperature than those normally applied in the industry using conventional Moebius or Balbach-Thum cells.

It is estimated that the total silver sand and gold mud tied-up in the above disclosed cell would be at least 50% less than in the conventional Moebius cell for an equivalent silver sand and gold mud production, thus resulting in substantial annual saving. The estimated floor area required for an equivalent silver sand and gold mud production using the continuous silver refining cell in accordance with the present invention is about the same as that using the Moebius cell. Furthermore, less labor is needed to operate the above continuous silver refining cell as both the silver sand and gold mud is delivered to the side of the cell without operator intervention. Another advantage is that the anodes dissolve completely, thus requiring no melting and recirculation of significant quantities of anode scrap.

Although the invention has been disclosed by way of example with reference to a preferred embodiment, it is to be understood that it is not limited to such embodiment and that other alternatives within the scope of the claims are also envisaged.

We claim:

1. A continuous silver refining cell comprising (a) a tank containing an electrolyte;

(b) at least one vertical cathode disk mounted on a rotating horizontal shaft placed above the tank so that slightly less than half of the disk is immersed in the electrolyte;

(c) at least one anode basket containing impure silver anodes immersed in the electrolyte adjacent the cathode disk;

(d) a diaphragm separating the cathode disk from the anode basket to form cathode and anode compartments;

(e) means located above the electrolyte level of the cell for continuously removing pure silver crystals from the cathode and directing it to the side of the cell;

(f) a bin located below the cell and connected to the bottom of the cell through pinch valves for collecting a mud containing gold and other precious metals from the bottom of the cell; and (g) means for continuously or semi-continuously withdrawing said mud from the bin.

2. A continuous silver refining cell as defined in claim 1, wherein the cathode disk is made of titanium or stainless steel.

3. A continuous silver refining cell as defining in claim 1, wherein the anode basket is made of titanium mesh.

4. A continuous silver refining cell as defined in claim 1, wherein the tank is divided into separate partitions to prevent any silver crystals falling from the cathode disks into the electrolyte to mix with the mud and wherein said diaphragm is placed in a window formed in said partition facing the cathode disk and the anode basket.

5. A continuous silver refining cell as defined in claim 1, wherein the electrolyte is introduced into the cathode compartment, passes into the anode compartment through the diaphragm and is circulated through filtering and heat exchanging equipment located outside the tank.

6. A continuous silver refining cell as defined in claim 1, wherein said means for continuously removing silver from the cathode disk is a scraper assembly comprising a blade contacting the surface of the cathode disk and forming one wall of a trough which is supplied with water from a water source for directing silver to the side of the cell.

* * * * *